United States Patent [19]

Forbush

[11] 4,171,796

[45] Oct. 23, 1979

[54] UTILITY WINCH

[76] Inventor: Dellis R. Forbush, 1395 E. Creek Rd., Sandy, Utah 84070

[21] Appl. No.: 879,891

[22] Filed: Feb. 21, 1978

[51] Int. Cl.[2] ..... A63B 61/04

[52] U.S. Cl. ..... 254/161; 254/64; 81/177 G

[58] Field of Search ..... 254/161, 164, 163, 169, 254/186 HC, 51, 79, 64, 83; 403/354, 355; 81/177 R, 177 G, 180 R, 184

[56] References Cited

U.S. PATENT DOCUMENTS

| | | | |
|---|---|---|---|
| 612,115 | 10/1898 | Mack | 254/161 |
| 1,008,788 | 11/1911 | Cornett | 254/161 |
| 1,341,180 | 5/1920 | Kern | 403/354 |
| 2,954,991 | 10/1960 | Seiden | 403/354 |

*Primary Examiner*—Robert J. Spar
*Assistant Examiner*—Kenneth W. Noland
*Attorney, Agent, or Firm*—B. Deon Criddle

[57] ABSTRACT

A utility winch that will allow wire, rope, or cable to be stretched. The winch includes a yoke frame with two holes to receive an internally driven, journalled drum to which the rope, cable, or wire is wound. A locking device fixes the drum with respect to the frame.

5 Claims, 5 Drawing Figures

UTILITY WINCH

BRIEF DESCRIPTION OF THE INVENTION

1. Field of the Invention

This invention relates to a system for stretching of wire, cable or rope to a taut condition.

2. Prior Art

The need for stretching or tightening cables, ropes, or wires has long been recognized. At the present time many circumstances exist wherein a cable, wire or rope needs to be stretched and held in a taut condition.

Various types of winches and reels are available on the market; but to the best of my knowledge, none allow the end of the wire, rope or cable to be inserted through the drum to provide means for locking the line and to act as a lock pin for engaging the handle with the drum so that the handle will rotate the drum to tighten the line. Also, many of the available tightening devices are expensive to produce and/or can not be locked in a wide variety of positions.

SUMMARY OF THE INVENTION

A principal object of the present invention is to provide a means whereby a wire, rope or cable can be connected to a drum and rotated into a stretched or taut condition. Another object is to provide a means whereby the wire, cable or rope line is locked to the drum by a turning handle and wherein the wire, cable or rope provides a drive means whereby the handle can rotate the drum. Still another object is to provide a means whereby the tightened or stretched line can be locked into place at multiple locations with a variety of locking pins.

Principal features of the invention includes a yoke frame having aligned holes through which a drum is journaled. Holes are also provided in the frame for locking pins, and one end of the line being tightened can be secured to the apex of the yoke.

Other objects and features of the invention will become apparent from the following detailed description taken together with the accompanying drawing.

THE DRAWING

In the drawing:

FIG. 1 is an exploded perspective view of the utility winch with handle shown fragmentarily and a locking pin;

FIG. 2, a top plan view of the utility winch showing a line inserted into the drum and another line connected to the apex of the yoke;

FIG. 3, a cross section view taken along the line 3—3 of FIG. 2 and showing the locking of a line by the handle and the positioning of the drum within the yoke;

FIG. 4, a perspective view showing a line wound around the drum, with a locking pin in the lock position and the handle removed; and FIG. 5, a perspective view similar to that of FIG. 4, but showing the location of another type of locking pin.

DETAILED DESCRIPTION

Figure 1:
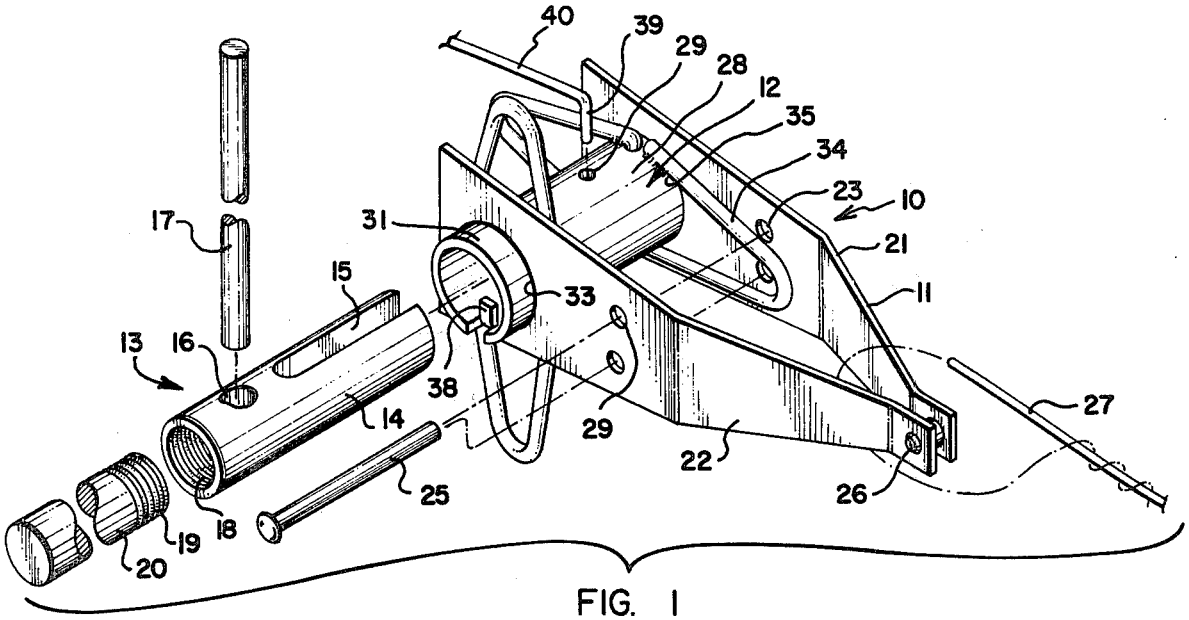
Figure 2:
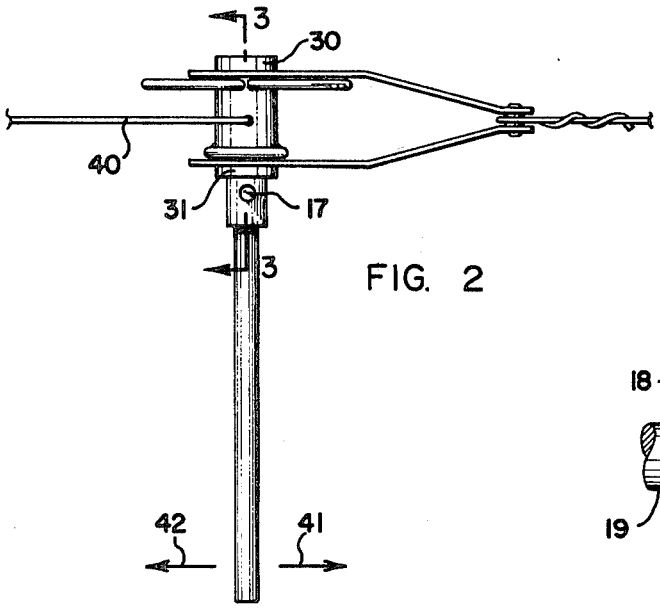
Figure 3:
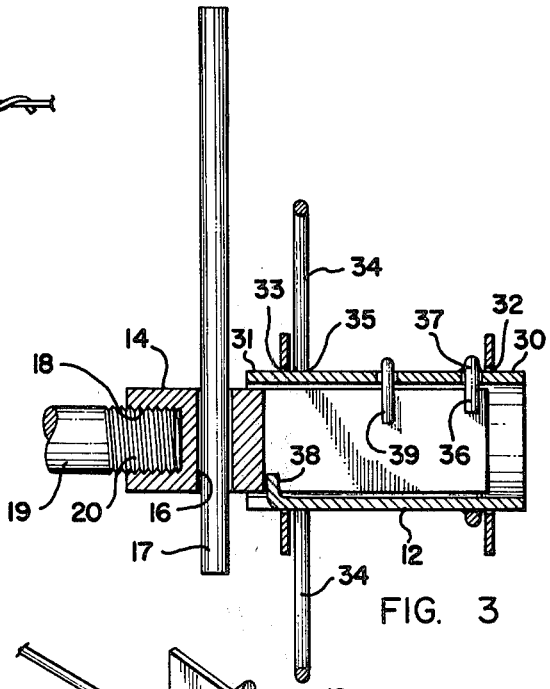
Figure 4:
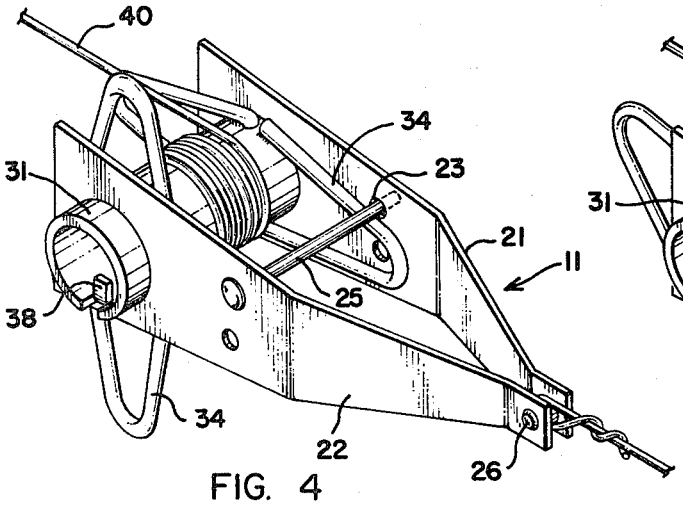

Referring now to the drawing:

In the illustrated preferred embodiment, the utility winch, shown generally at 10, includes a yoke shown generally at 11, and a drum 12. A utility winch handle, shown generally at 13, comprises a wrench 14 having a locking slot 15 and a transverse hole 16 to receive a torquing rod 17. The wrench 14 also preferably has a threaded bore 18 into which a threaded portion 19 of handle 20 may be turned.

The yoke 11 has leg portions 21 and 22 and at least one set of aligned holes 23 and 24, respectively through the legs. A locking pin 25 may be inserted through holes 23 and 24 to lock rotation of drum 12 against further rotation, as will be further explained. The yoke 11 may be made of one piece of strap material bent at its apex, but as shown comprises two separate leg portions, interconnected at the apex by a fastener such as the rivet 26. The leg portions are angled to spread outwardly from the apex and the rivet 26 then serves as a means to which a line (such as a strand of fence wire) can be anchored by turning it around the rivet and wrapping it around itself.

The drum, shown generally at 12 includes a central cylindrical housing 28 (which may be formed from a section of pipe) with a hole 29 through the wall thereof. The ends 30 and 31 of housing 28 extend through openings 32 and 33 of the yoke leg portions 21 and 22, respectively. Drum 12 also includes an extension comprising at least one rigid wire loop 34, each of which loop is welded to drum 12 at 35 to serve as part of a locking means for locking the rotation of the drum with respect to the yoke. At least one wire loop 34 may be constructed to include a finger 36 arranged to extend inwardly through opening 37 of drum 12 at the central portion of housing 28. The inwardly extending finger 36 thereby creates another engagement means for coupling the wrench 14 to drum 12. Drum 12 may also include a rigid tab 38, here shown as formed by bending a portion of the end portion 31 of drum 12 inwardly. The tab 38 then also acts as a driving means by which the wrench 14 can be used to rotate the drum 12.

In operation, a free end of an anchor line such as wire 27 is connected to the apex of yoke 11 at rivet 26. The other end of the line is secured, thereby fixing the position of the utility winch. Wrench 14 is then inserted into the drum 12 with the slot 15 of the wrench 14 straddling tab 38 and finger 36, as well as the inwardly extending end portion 39 of wire 40. Torquing rod 17 is inserted into opening 16 of wrench 14, so that as the torquing rod 17 is turned slot 15 rotates to lock against extended finger 36, tab 38, and the end portion 39 of line 40, thereby causing the drum 12 to rotate. As drum 12 rotates the line 40 is wrapped around the central portion 28 of drum 12 receiving line 40 therearound until the desired tautness is achieved. To help wind the line 40 evenly along the central portion 28 of the drum 12, the handle 19 is turned into threaded opening 18. By moving handle 19 in either direction, as indicated by arrows 41 and 42, the position of drum 12 is aligned to evenly receive the line.

Figure 5:
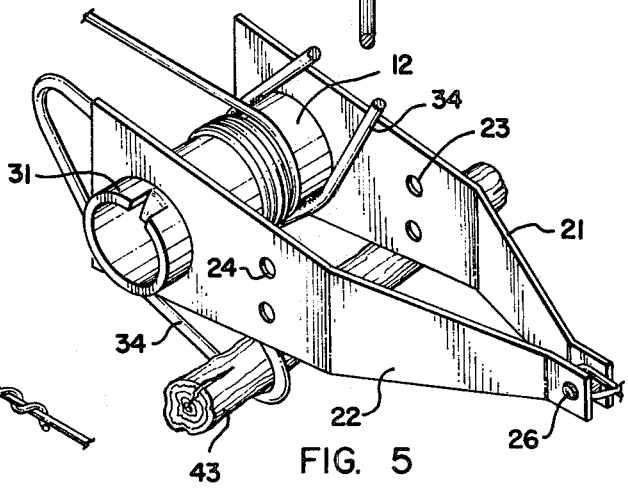

When desired line tautness is achieved, a locking pin 25 is inserted through aligned holes 23 and 24. Wrench 14 is then removed and the wire 40 recoils it slightly rotates drum 12 until the extended wire loops 34 engage the locking pin 25, thereby locking the drum 12 against further rotation. As shown best in FIG. 5, a stick or the like can also be used to form a locking pin 43 that will project through a looped portion of an extended wire loop 34. The pin then locks against yoke straps 21 and 22, respectively, to thereby lock the drum 12 against rotation.

Although a preferred form of my invention has been herein disclosed, it is to be understood that the present disclosure is made by way of example and that variations are possible without departing from the subject matter coming within the scope of the following claims, which subject matter I regard as my invention.

I claim:

1. A utility winch comprising a yoke having a generally U-configuration;

a cylindrical drum having opposite ends respectively extending through and rotatable in legs of the yoke;

locking means including extension means comprising a rigid wire loop affixed to the exterior of the drum, projecting from the drum, and said locking means also includes removable means cooperative with at least one said leg and either an inside or an outside portion of said extension means to thereby selectively fix the position of the drum relative to the legs; and means for rotating the drum, said rotating means including a wrench fitting into the cylindrical drum and means inside the drum to be engaged by the wrench for turning the drum.

2. A utility winch as in claim 1, wherein the means for rotating the drum includes an end of the rigid wire loop extending into the drum to be engaged by the wrench.

3. A utility winch as in claim 2, wherein the means for rotating the drum further includes a hole through the wall of the cylindrical drum, whereby the end of a line to be wrapped on the drum is inserted through the drum to be engaged by the wrench.

4. A utility winch as in claim 3, wherein the means inside the drum includes a tab extending inwardly of the drum to be engaged by the wrench.

5. A utility winch as in claim 4, wherein the locking means includes a plurality of extensions, angularly spaced around the drum and projecting therefrom to cooperate with at least one removable means for fixing the rotary position of the drum relative to the leg.

* * * * *